United States Patent [19]

Brenner, Jr.

[11] 4,243,908

[45] Jan. 6, 1981

[54] ELECTRICAL CONNECTIVE MEANS FOR A CRT MASK-PANEL ASSEMBLY

[75] Inventor: Kurt H. Brenner, Jr., Seneca Falls, N.Y.

[73] Assignee: GTE Products Corporation, Stamford, Conn.

[21] Appl. No.: 30,249

[22] Filed: Apr. 16, 1979

[51] Int. Cl.[3] ..... H01J 29/07

[52] U.S. Cl. ..... 313/407; 313/477 HC

[58] Field of Search ..... 313/482, 407, 406, 408, 313/404, 405

[56] References Cited

U.S. PATENT DOCUMENTS 3,931,541 1/1976 Brenner ..... 313/407

4,128,790 12/1978 Steeghs ..... 313/408 X

FOREIGN PATENT DOCUMENTS 2622695 12/1977 Fed. Rep. of Germany ..... 313/404

*Primary Examiner*—Robert Segal

*Attorney, Agent, or Firm*—Theodore D. Lindgren

[57] ABSTRACT

The invention provides an improvement in the electrical connective means for effecting interconnection between the mask electrode and panel components in a color cathode ray tube. A protruding element on the resilient contactor mates with an aperture in the mask frame to provide a contactor retention and release mechanism which is beneficially utilized during screen fabrication.

9 Claims, 8 Drawing Figures

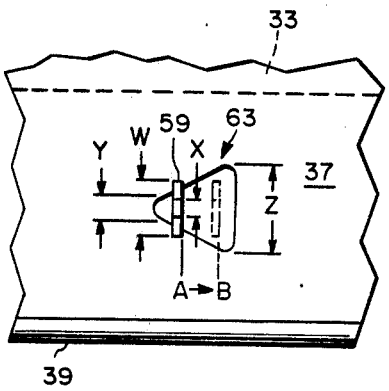
FIG. 4
FIG. 5
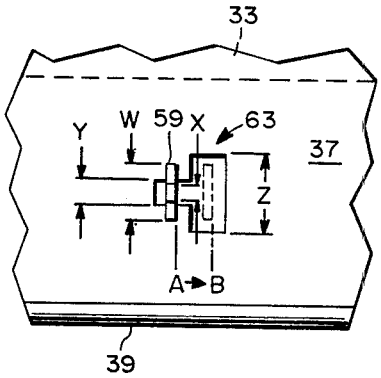
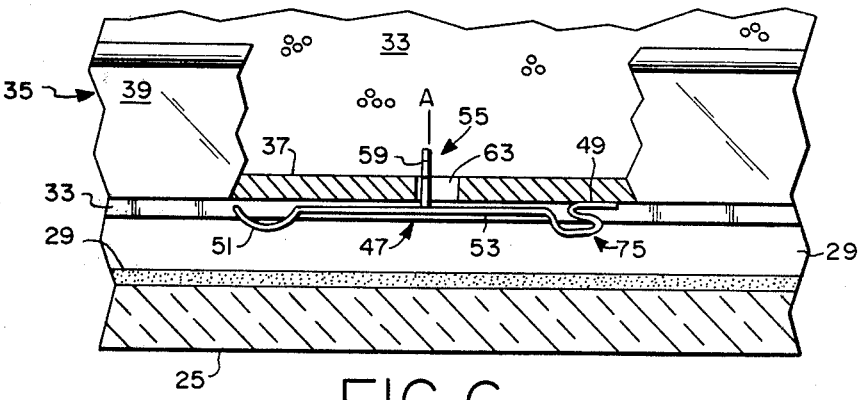
FIG. 6

ELECTRICAL CONNECTIVE MEANS FOR A CRT MASK-PANEL ASSEMBLY

TECHNICAL FIELD

This invention relates to electrical interconnective means within a cathode ray tube and more particularly to an improvement in the connective means effecting interconnection between the mask electrode and panel components in a color CRT mask-panel assembly.

BACKGROUND ART

By way of example, the envelopes of color cathode ray tubes (CRT's), of the shadow mask type often employed in television applications, are conventionally fabricated as an integration of neck, funnel and face panel components. The glass panel includes a viewing area having a cathodoluminescent screen interiorly formed thereon and a perimetrical sidewall therearound. The interior of the panel, including the screen and the surrounding panel sidewall, is usually metallized with a film of aluminum after formation of the patterned screen. This metallic film serves two functions: first, it provides a portion of the electrical conductive path for the screen potential, and second, it provides a reflective film upon the back of the screen thereby enhancing the frontal brightness thereof. Spatially positioned within the panel component is a multiple-opening mask component formed of a substantially domed foraminous portion, the edge of which is peripherally affixed to a rigid circumscribing framing member. This composite mask component, which is often referred to as a shadow mask, is supported within the panel, in spaced relationship to the viewing area and the surrounding sidewall, by a plurality of suitable positional means attached about the framing member in a manner to mate with supporting studs embedded in and projecting from the sidewall of the panel.

Upon completion of the screen fabricating procedure, the aforedescribed mask-panel assembly is hermetically sealed to the funnel component of the envelope. Electron generating means in the form of an integrated assembly comprising one or more electron guns, is then positioned and sealed within the neck component of the envelope, whereupon the tube is subsequently evacuated, sealed and processed.

In color CRT's of the shadow mask variety, the conventional operating screen potential is substantially that of the final anode electrode of the electron gun assembly, such being achieved by a diverse internal conductive path within the envelope. The final anode electrodes of the gun assembly usually make electrical contact through associated supportive snubber means with an electrically conductive coating, such as Aquadag, which is applied to the interior surface of the funnel component of the envelope. Usually, the highest operating potential is applied to this conductive coating by means of a button-type connection oriented through the wall of the funnel. The other differential potentials required for the successful operation of the electron guns in the assembly, are supplied to the respective electrodes therein by specific electrical conductive means terminating at the connective pins or leads traversing the closure portion and base of the tube. These protruding pins, in turn, are connected to suitable voltage sources external of the tube.

The final anode potential, which is supplied to the conductive coating on the interior surface of the funnel, is connected to the apertured mask by at least one resilient contact member attached to the mask framing member and extended therefrom to make pressured contact with the coating.

Exemplary electrical connection between the mask and screen components of the assembly is effected through the spaced-apart mask positioners in conjunction with the mating supporting studs protruding from the panel sidewall and the aluminized film disposed thereon. The studs are usually kept free of aluminum film to avoid the prevalence of metallic flakes resultant of subsequent mask positioning in the panel. Since the mask positioning means per se make riding contact on the wall-oriented supporting studs, electrical connection between the mask and the aluminized sidewall of the panel is provided by applying an area of an additional conductive coating, such as Aquadag, to a portion of at least one of the studs proper, making overlapping contact with the adjacent aluminum film to insure an electrical connection between the stud and the aluminum disposed on the panel sidewall. Since application of this discrete area of Aquadag is usually a manual operation, there have been occasions of inherent human deviation when the resultant electrical connection was less than desired. Additionally, deleterious effects have been evidenced in the form of erosion between the Aquadag and the aluminum film, accidental splashing of Aquadag on the screen, and the undesirable prevalence of scraped-off loose particles and flakes of Aquadag in the vicinity of the screen and mask.

Another means for achieving electrical connection between the mask and panel components of the mask-panel assembly is a resilient connective means of the type disclosed in U.S. Pat. No. 3,931,541, assigned to the assignee of this invention. The referred-to connective means, incorporated into the mask-panel assembly, is comprised of an attachment portion affixed to the framing member and an integral flexured contact portion located in a manner to extend forwardly in the spacing existent between the framing member and the conductive panel sidewall. There have been instances when careless insertion resulted in undesired abrasion of the aluminum film resulting in the possible presence of deleterious particlized material in the screen and mask regions.

DISCLOSURE OF INVENTION

The present invention is addressed to expeditious means for overcoming the aforementioned disadvantages by the provision of an improvement in the electrical connective means effecting interconnection between the mask and the panel of a color CRT mask-panel assembly. The electrical contactor of the invention is formed as a longitudinal resilient conductive member having a mask attachment portion, an opposed contact portion and an intermediate flexural portion therebetween. The intermediate flexural portion contains an integral structure bent angularly therefrom to form a tab-like projecting retention-release element. When the contactor is affixed for usage, the tab-like projection is oriented to extend toward the framing member of the mask, wherein a discretely configurated aperture is dimensionally formed to receive and interact in a cooperating manner with a section of the projecting element. By this interaction, the contactor is desirably retained in a retracted position proximal to the mask. This is beneficial positioning when inserting the mask within the panel. Upon subsequent manipulation of the element, the contactor is released from the aperture to make positive pressured contact with a conductive area on the sidewall of the panel.

BRIEF DESCRIPTION OF THE DRAWINGS

FIGS. 4 and 5 are enlarged plan views of two configuration embodiments of the cooperating aperture formed in the mask framing member taken along the line 4—4 of FIG. 2.

FIGS. 6 and 7 are related enlarged side views illustrating operation of the invention taken along the line 7—7 of FIG. 2.

BEST MODE FOR CARRYING OUT THE INVENTION

For a better understanding of the present invention together with the advantages and capabilities thereof, reference is made to the following specification and appended claims in connection with the aforedescribed drawings.

The improvement in the electrical connector means of the invention will be herein exemplarily described and shown as applying to a shadow mask type of color CRT environment, but the breadth of the improved connective concept is not intended to be limited thereto. For example, the improved contactor means is equally applicable to a post deflection CRT utilization, wherein a specific electrical potential may be applied solely to the mask electrode member through the medium of an insulated band of conductive material, applied to a discrete area of the panel sidewall, making contact therewith through a related button connection therein.

Figure 1:
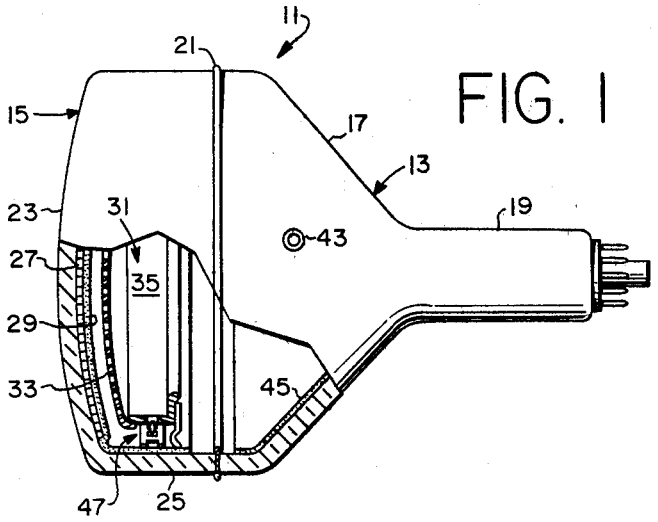
FIG. 1 is a partially sectioned view of a color cathode ray tube wherein the invention is utilized.

With reference to the drawings, there is shown in FIG. 1, an exemplary shadow mask color CRT 11 having an envelope 13 comprised of an integration of panel, funnel and neck components, 15, 17 and 19 respectively, whereof the panel 15 is hermetically joined to the mouth of the funnel 17 along the continuous seal line 21. The glass panel 15 has a viewing area 23 and a perimetrical sidewall portion 25 therearound.

Disposed on the interior surface of the viewing portion of the panel 15 is a patterned cathodoluminescent screen 27 formed of a multitude of precise areas of selected color-emitting phosphor materials. Some screen constructions also employ a superimposed film or matrix of opaque material having multitudinous openings therein explicitly defining the patterned phosphor areas. To present simplicity, such is not shown in this instance. Conventionally, a thin metallized film 29, such as aluminum, is disposed over the interior surface of the screen and continued onto at least a portion of the adjacent sidewall area of the panel.

Spatially oriented within the panel is a mask component 31 having a foraminous areal portion 33 precisely related to the viewing area of the screen 27. This foraminous member is peripherally affixed to a rigid framing member 35. The mask component 31 is predeterminately positioned within the panel 15 by usual means such as several spaced-apart supporting stud-like metallic members embedded in the sidewall of the panel and projecting therefrom to mate with locators attached to the side portion 37 of the framing member of the mask. For purposes of clarity, the conventional stud-like supporting means and mask locators are not shown in the drawings.

Also making up an integral part of the mask framing member 35 is a substantially perimetric ledge portion 39 terminally instanding from the side portion 37 in a manner substantially normal thereto. Attached to this ledge portion is a peripheral strip-like beam shielding means 41 which is positioned to extend from the mask framing member in a bridging manner to make contact with the panel sidewall. Being so oriented, this shielding means 41 protects the screen from deleterious electron excitation resultant from the peripheral overscan of electron beams emanating from the electron gun assembly, not shown, which is positioned within the neck component 19 of the tube envelope.

From an operational consideration, the final anode or screen potential is conventionally applied to the tube 11 through an electrically conductive button connection 43, which traverses and is hermetically sealed in the wall of the funnel component 17. Internally, the button makes connection with an electrically conductive coating 45, such as Aquadag, which is applied to the interior surface of the funnel 17 usually extending thereover from a region adjacent the seal 21 into the forward area of the neck where contact is made with the final electrodes of the electron gun assembly. The electrical connection between the funnel coating 45 and the mask component 31 is usually achieved by a resilient snubber means, not shown, which being attached to the framing member 35, extends therefrom into the funnel making contact with the conductive coating 45 thereon.

The invention relates to an improvement in the electrical connective means effecting interconnection in a CRT mask-panel assembly between the mask component 31 and the metallized sidewall 25 of the panel. As detailed in FIG. 3, the electrical contactor 47 is formed as a substantially longitudinal member of flexible resilient metallic material, such as non-magnetic tempered stainless steel, as for example 304 S.S. of a nominal thickness substantially within the range of 0.15 to 0.20 mm. The contactor comprises an attachment portion 49, an opposed contact portion 51, and an intermediate flexural portion 53 therebetween. Extending in an angular manner from the flexural portion is an integral tab-like structure 55 which functions in the operation of the invention as a retention-release element cooperating with a configurated aperture formed in the framing member, as subsequently described. As shown, this tab-like element is a cut-out structure fabricated as by stamping from a segment of the flexural portion, such being bent in an angular manner to project therefrom. While, in this instance the complete contactor is formed as a one-piece structure, it is evident that the tab-like element could be a bonded appendage, if such construction is desired. The tab-like element 55 is of definitive shaping being formed to have a stem segment 57 of width "x" terminated by a crown segment 59 evidencing a basal width "w" that is greater than that of the stem and having a lower or basal edge 61 proximal to mergence with the stem segment 57. Basically, the crown segment 59 is fabricated to have a terminal width "v" markedly less than the basal width "w" thereof.

Figure 2:
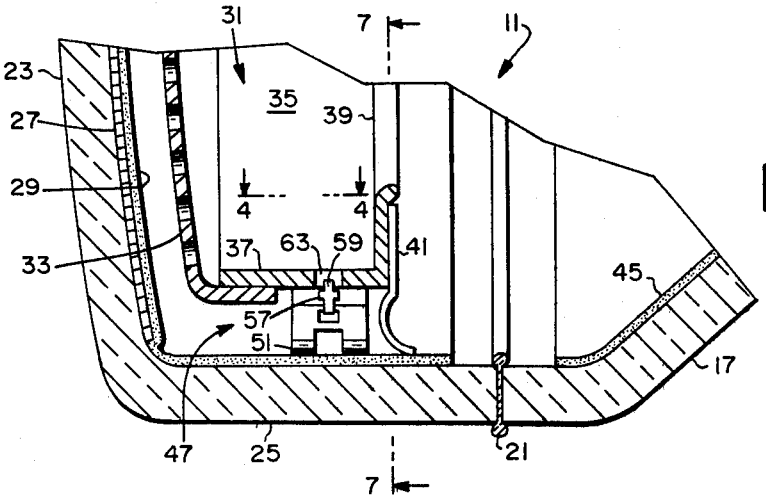
FIG. 2 is an enlarged section of FIG. 1 detailing the region of the invention.
Figure 3:
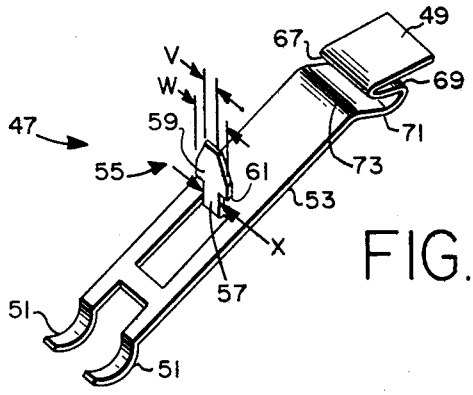
FIG. 3 is a perspective of one embodiment of the electrical connective means of the invention prior to incorporation in the mask-panel assembly.
Figure 7:
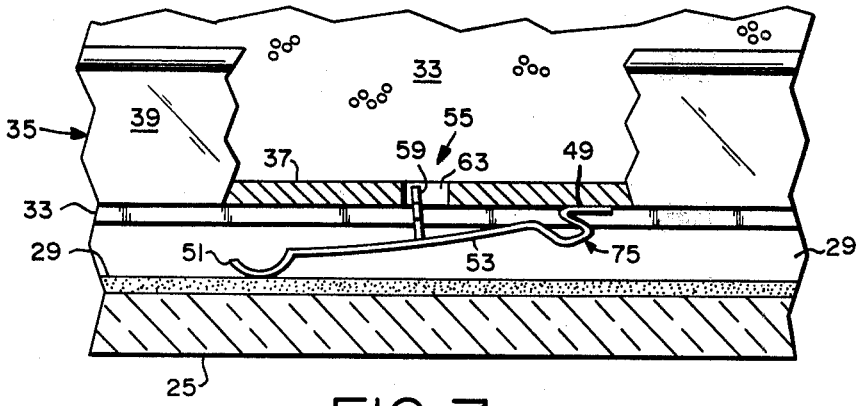

For example, such dimensioning is evidenced in FIG. 2 wherein the crown is configurated substantially in the shape of an inverted T. Another modified shaping is shown in FIG. 3 wherein the crown is of a substantially generalized triangular configuration. In both embodiments, the basal and terminal width differentiations are important considerations in the desired interaction with the mating aperture in the framing member, such is subsequently described herein. Formed in the side portion 37 of the framing member 35 is a cooperative mating aperture, as exemplarly shown in FIGS. 4 and 5 as 63 and 65 respectfully, such being configurated dimensionally to receive and interact with a section of the projecting tab-like element 55. This interaction effects a spring-loaded retract-release mechanism whereby the contactor 47 is desirably retained in a retracted position proximal to the framing member, as illustrated in FIG. 6, and then upon subsequent manipulation the restraining action of the tab-like element is released permitting flexural movement of the contactor, as shown in FIG. 7, to make positive pressured contact with the conductive aluminum film 29 on the panel sidewall 25.

In considering the invention in greater detail, reference is again directed to FIG. 3 wherein the constructional features of the electrical contactor 47 are delineated. In this embodiment, the intermediate flexural portion 53 of the contactor 47 has a group of related transverse bends, such as 67, 69, 71 and 73, formed thereacross in the region proximal to the attachment portion 49. These cooperating bends, which may be acute, obtuse or arcuate, provide a primary structural concentration of conjunctive flexural moments 75 which augment the flexural aspects of the contactor 47.

As shown in FIGS. 1, 2, 6 and 7, the contactor 47 has its attachment portion 49 fixedly attached, as by welding, to the side portion 37 of the framing member 35 in a manner to extend the contactor substantially longitudinally therealong, thereby effecting side-mounted orientation.

The configurated aperture, formed in the side portion of the framing member 35 to receive and interact with the projecting tab-like structure 55 of the contactor, is detailed in FIGS. 4 and 5 wherein exemplary embodiments 63 and 65 are delineated. Fundamentally, the aperture is shaped to have a narrow width dimension "y" related to one end thereof that is slightly in excess of the lateral width "x" of the stem portion 57. In the formation of the aperture, dimensioning thereof is increased from the narrow width "y" to a wider width "z" that is in excess of the lateral width "w" of the crown portion 59. In FIG. 4, the aperture embodiment 63 is substantially configurated as an isosceles triangle wherein the narrow width "y" is related to the apex region thereof. In the embodiment illustrated in FIG. 5, the aperture 65 is substantially shaped as a T-like formation wherein the narrow width "y" is related to the shaft portion thereof. It is within the scope of the invention to modify the aperture configurations shown and still maintain the required fundamental dimensioning considerations evidencing two functional widths.

The interaction of the contactor projection 55 and the aperture, such as 63, in the framing member is particularly delineated in FIGS. 2, 4, 5, 6 and 7 of the drawings. For example, the contactor 47 is side-mounted on the framing member 35 with the attachment portion 49 affixed thereto. Being so oriented, the tab-like structure 55 of the contactor projects through the aligned aperture in the framing member. As previously mentioned, the shaping of the receiving aperture may be either of the embodiments 63 or 65, as shown in FIGS. 4 and 5, or related modifications thereof. As illustrated, the crown segment 59 completely protrudes through the aperture. The orientation and the inherent resilience of the contactor structure 47 effected by the tempered material thereof and the augmenting structural concentration of flexural moments 75, positions the crown at the locking or retaining location "A", in the forward or narrow dimension region of the aperture. At this location, the basal edge 61 of the crown segment is pressured against the inner surface of the frame side portion 37. Being so located, the contactor is temporarily locked in a position closely adjacent to the side of the framing member, as shown in FIG. 6. This out-of-the-way side positioning of the contactor minimizes the chances of the contactor abrading the conductive film 29 on the sidewall portion 25 of the panel during the procedural steps in screen fabrication when the mask component 31 is positioned within and removed from the panel component 15. When the final positioning of the mask within the panel is consummated, the crown segment 59 of the tab is moved to location "B", FIGS. 4 and 5, by either manual or mechanical means. At position "B", in the wider dimensioned region of the aperture, the crown segment 59 is released from the retaining region of the aperture and flexurally pulled outward, as shown in FIG. 7, through action of the structural concentration of flexural moments 75. Since the terminal width "v" of the crown segment 59 is of reduced dimensioning, it adequately clears the narrow "y" dimensioned region of the cooperating aperture. Thus, the contact means 51 of the contactor 47 are permitted to make positive pressured contact with the panel disposed aluminum film 29 thereby effecting a reliable electrical connection between the mask and the panel with no deleterious abrasion of the film disposed in the panel sidewall.

Figure 8:
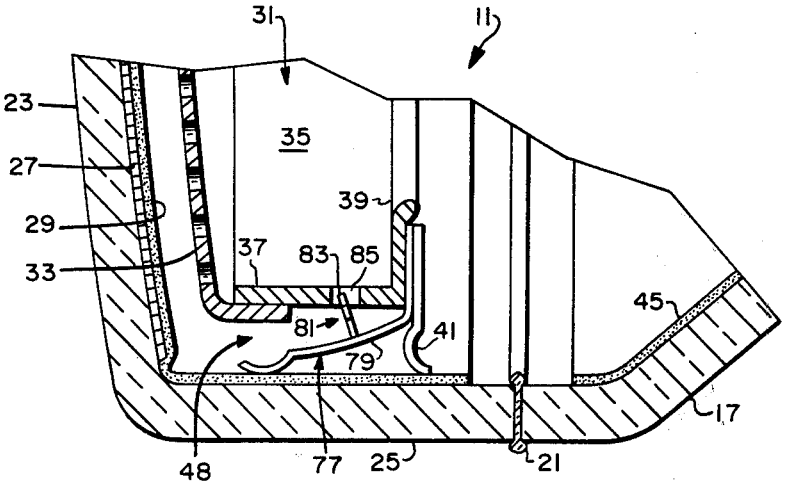
FIG. 8 is an enlarged section detailing another embodiment of the invention.

Another embodiment of the invention is shown in FIG. 8, wherein a modified electrical contactor 77 is fixedly attached, as by welding, to the ledge portion 39 of the framing member 31. By this mounting, the flexural portion 79 of the contactor is flexurally bent or arced over the edge of the frame and extended adjacent to the frame. The tab-like structure 81, which is similar to that already described, has a crown segment 83 protruding into the mating aperture 85. This cooperating aperture is similar to 63 and 65 shown in FIGS. 4 and 5, with the exception that aperture 85 is located in a position rotated 90 degrees from the orientation of apertures 63 or 65 to conform with the orientation of the cooperating tab 81. In this embodiment the resilient tensioning of the contactor is provided by the arced formation of the flexural portion 79. The resultant retention-release interaction of the re-oriented tab and aperture arrangement is similar to that described for the first embodiment.

After final positioning of the mask within the panel and release of the contactor 47 (or 77) to effect electrical connection therebetween, beam shielding means 41 are attached to the mask framing member 35 in a manner to bridge the spacing between the spacing between the frame and the panel sidewall. This shielding means, which is suitably affixed to the framing member, prevents overscan of the electron beams from reaching the screen.

While there has been shown and described what are at present considered the preferred embodiments of the invention, it will be obvious to those skilled in the art that various changes and modifications may be made therein without departing from the scope of the invention as defined by the appended claims.

INDUSTRIAL APPLICABILITY

The invention provides an improvement in the structural means for effecting an electrical connection between the mask electrode and a portion of the panel in a color CRT. The improved contactor has a built-in retention and release element which cooperates with a mating aperture in the mask frame. This mechanism enables the contactor to be retracted close to the frame during the screen fabrication operations when the mask is inserted into and removed from the panel several times. Upon final assembly, the contactor is released from the retracted position to make pressured contact with the panel sidewall. The improved contactor eliminates the necessity of applying aquadag to the mask supporting studs and minimizes the possibility of surface abrasion of the coating on the panel sidewall during insertion of the assembly. Thus, the invention greatly reduces the possibility of deleterious loose particles within the envelope, thereby providing a finished tube product of improved quality.

I claim:

1. An improvement in the electrical connective means effecting interconnection between the mask electrode and a discrete area of the panel in a color cathode ray tube mask-panel assembly whereof the glass panel component includes a viewing area having a cathodoluminescent screen interiorly formed thereon and a perimetrical sidewall therearound whereon an electrically conductive film is interiorly disposed on at least a portion of the panel; and whereof the mask electrode component of said assembly, spatially supported within said panel, includes a viewing area-related foraminous portion peripherally affixed to a rigid framing member having a side portion spatially and substantially parallelly related to said panel sidewall, said framing member having a contiguous ledge portion terminally instanding from said side portion, said interconnection improvement comprising: an electrical contactor formed as a longitudinal resilient conductive member having an attachment portion affixed to said framing member, an opposed contact portion and an intermediate flexural portion therebetween, said flexural portion having an integral structure bent angularly therefrom to form a tab-like projecting retention-release element extending toward said framing member; and a discretely configurated aperture formed in the side portion of said framing member, said aperture being dimensioned to receive and interact in a cooperating manner with a section of said projecting retention-release element to effect a retract-release mechanism whereby said contactor is desirably retained in a retracted position proximal to said framing member and upon subsequent manipulation of said projecting element is released permitting flexural movement of said contactor to make positive pressured contact with an area of conductive film discretely disposed on said panel sidewall.

2. The improvement in the electrical connective means in a CRT mask-panel assembly according to claim 1 wherein said electrical contactor is fixedly attached to the side portion of said framing member in a manner to extend substantially longitudinally therealong effecting side-mounted orientation.

3. The improvement in the electrical connective means in a CRT mask-panel assembly according to claim 1 wherein said electrical contactor is formed as a one-piece structure.

4. The improvement in the electrical connective means in a CRT mask-panel assembly according to claim 1 wherein the intermediate flexural portion of said electrical contactor has a group of related transverse bends formed thereacross in the region proximal to said attachment portion to provide a primary structural concentration of conjunctive flexural moments in said contactor.

5. The improvement in the electrical connective means in a CRT mask-panel assembly according to claim 1 wherein said tab-like retention-release element projecting from said contactor is fabricated of a stem segment of defined width terminated by a crown segment evidencing a basal width greater than that of said stem segment, said crown having a basal edge proximal to said stem, and wherein said configurated aperture in the side portion of said framing member is formed to have a narrow width dimension slightly in excess of the lateral width of said stem portion, in the formation of said aperture dimensioning thereof increases from said narrow width to a wider width in excess of the lateral width of said crown portion.

6. The improvement in the electrical connective means in a CRT mask-panel assembly according to claim 5 wherein the crown segment of said tab-like projecting element is formed to have a terminal width markedly less than said basal width thereof.

7. The improvement in the electrical connective means in a CRT mask-panel assembly according to claim 6 wherein said crown segment is configurated substantially in the shape of an inverted T.

8. The improvement in the electrical connective means in a CRT mask-panel assembly according to claim 6 wherein said crown segment is configurated substantially as a generalized trianglar shaping.

9. The improvement in the electrical connective means in a CRT mask-panel assembly according to claim 1 wherein said electrical contactor is fixedly attached to the ledge portion of said framing member with said flexural portion being arced thereover to said side portion to facilitate the interaction of said retention-release element with a compatible aperture formed in the side portion of said framing member.

* * * * *